United States Patent [19]

Hori et al.

[11] 4,059,239

[45] Nov. 22, 1977

[54] METHOD AND APPARATUS FOR WINDING A THREAD ON A BOBBIN AT A HIGH WINDING SPEED

[75] Inventors: Kikuo Hori; Takumi Horiuchi; Mikio Nishikawa; Shiro Ryugo; Akira Ishizuka; Yoshisuke Takenaka, all of Matsuyama, Japan

[73] Assignee: Teijin Limited, Osaka, Japan

[21] Appl. No.: 628,152

[22] Filed: Nov. 3, 1975

[30] Foreign Application Priority Data

Nov. 6, 1974 Japan ..... 49-127814

[51] Int. Cl.[2] ..... B65H 54/38

[52] U.S. Cl. ..... 242/18.1; 242/18 R; 242/18 DD; 242/45

[58] Field of Search ..... 242/18 DD, 18.1, 18 R, 242/45

[56] References Cited

U.S. PATENT DOCUMENTS

| | | | |
|---|---|---|---|
| 2,524,121 | 10/1950 | Crouzet | 242/18.1 UX |
| 3,374,960 | 3/1968 | Stanley | 242/18.1 |
| 3,402,898 | 9/1968 | Mattingly | 242/18.1 X |
| 3,451,209 | 6/1969 | Bisset et al. | 242/18.1 X |
| 3,452,533 | 7/1969 | Bisset et al. | 242/18.1 X |
| 3,452,534 | 7/1969 | Bisset et al. | 242/18.1 X |
| 3,488,938 | 1/1970 | Johnson et al. | 242/18.1 X |
| 3,638,872 | 2/1972 | Jennings | 242/18.1 |
| 3,847,364 | 11/1974 | Rohner et al. | 242/18.1 |

FOREIGN PATENT DOCUMENTS

| | | | |
|---|---|---|---|
| 862,576 | 2/1971 | Canada | 242/18.1 |

*Primary Examiner*—Stanley N. Gilreath
*Attorney, Agent, or Firm*—Kenyon & Kenyon

[57] ABSTRACT

In an operation for winding a synthetic thread on a cylindrical bobbin for producing a full size yarn package at a winding speed more than 2500 m/min, the possible creation of defective yarn winding is positively prevented by increasing the tightness of the winding thread on a just previously formed thread layer of the yarn package, at least once in a predetermined period defined by a critical condition. Such predetermined period is defined by $$1.20\times10^{-6} \leqq (dw/dt)D \leqq 3.0\times10^{-6}$$

wherein $w$ represents the number of bobbin rotations per one reciprocal traverse motion, $t$ represents the time in minutes and D represents the thickness of the thread in denier. The above-mentioned winding tightness is created by intentionally increasing the winding yarn tenson and/or increasing the contact pressure of the yarn package with a friction driving roller.

18 Claims, 13 Drawing Figures

METHOD AND APPARATUS FOR WINDING A THREAD ON A BOBBIN AT A HIGH WINDING SPEED

BACKGROUND OF THE INVENTION

The present invention relates to an improved method and apparatus for effectively winding a thread on a bobbin at a winding speed of more than 2500 m/min, whereby very smooth unwinding of the thread from the yarn package formed on the bobbin is facilitated.

In the textile industry such as the synthetic fiber manufacturing industry, it is the recent tendency that a non-drawn synthetic thread delivered from a spinning process or a drawn thread delivered from a spin-draw process is taken up at a high takeup speed of more than 2500 m/min, by the high speed running of a takeup device, so as to form a yarn package on a bobbin.

According to our experience, when the revolutions per minute of the bobbin during the winding (or takeup) process have some integral whole number relationship to the traverse rate, it may be seen the pattern or yarn placed on the yarn package is repeated. This pattern or yarn winding is well-known as "ribboning". When such "ribboning" is created during the winding operation of a synthetic filament on a bobbin, the thread layer formed on an axial end portion of the yarn package has a tendency to slide toward the axial middle portion of the yarn package. When such slip of the thread layer occurs, the thread is normally broken so that the desired full yarn package can not be produced. Even though the thread is not broken, the slipped thread layer creates an entanglement of thread when the thread is unwound from the yarn package in the subsequent process, so that the subsequent process can not be carried out in a stable condition and a good quality product can not be produced. Such defective yarn winding is frequently created in the winding (or takeup) operation under a condition of high speed winding. In the case of winding synthetic thread treated with an oiling agent having low frictional resistance, the above-mentioned defective yarn winding tends to frequently occur.

SUMMARY OF THE INVENTION

The principal object of the present invention is to provide an improved method and apparatus for winding a thread on a bobbin at a high winding speed of more than 2500 m/min without creation of the above-mentioned defective yarn winding.

In the following description, the above-mentioned defective yarn winding is simply referred to as a defective yarn winding, for the sake of simplifying the explanation.

To attain the purpose of the present invention, fundamental research to find the time of first occurance of the defective yarn winding was carried out, and repeated experimental tests were made to find a perfect solution to prevent the creation of the defective yarn winding during the winding operation. According to the above-mentioned fundamental research, the defective yarn winding is possibly created when dw/dt is reduced to a critical value such as $1.20\times10^{-6}D$, wherein w represents the number of winds during one complete transverse motion of the yarn guide, D represents the thickness of the winding thread in denier, and t represents time in minutes. According to our experimental tests, it is very effective to tightly wind the yarn on the layer of the yarn package just previous to the layer where ribbon winding may occur so as to prevent the creation of the defective yarn winding. Increasing the yarn tension or the contact pressure between the yarn package and a friction drum is a very effective method of winding yarn on such a previously formed layer of the yarn package in a tight condition so that the creation of a defective yarn winding can be prevented. Consequently, the above-mentioned increase of the yarn tension or contact pressure is stepwisely applied to the winding operation right before a critical time for the creation of ribboning or defective yarn winding. According to our repeated experimental test, such critical time corresponds to $dw/dt \approx 1.20\times 10^{-6}$ D.

In the apparatus according to the invention, such critical time is detected by a detecting device, and the winding tension or the contact pressure is mechanically increased stepwisely so that the thread is wound on the previously formed layer of the yarn package in tighter condition. Consequently the creation of the defective yarn winding can be perfectly prevented. Instead of detecting the critical time, the contacting pressure between the yarn package and the friction roller or the winding yarn-tension may be increased in steps by programmed control.

DETAILED DESCRIPTION OF THE INVENTION

Figure 1:
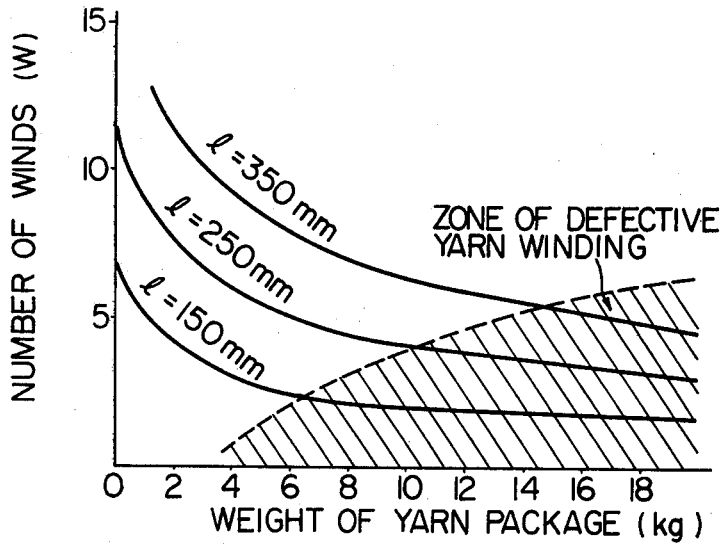
FIG. 1 is a graphical representation showing a relation between the number of winds w (i.e., bobbin revolutions per traverse) and the weight of a yarn package during the winding operation.
Figure 2:
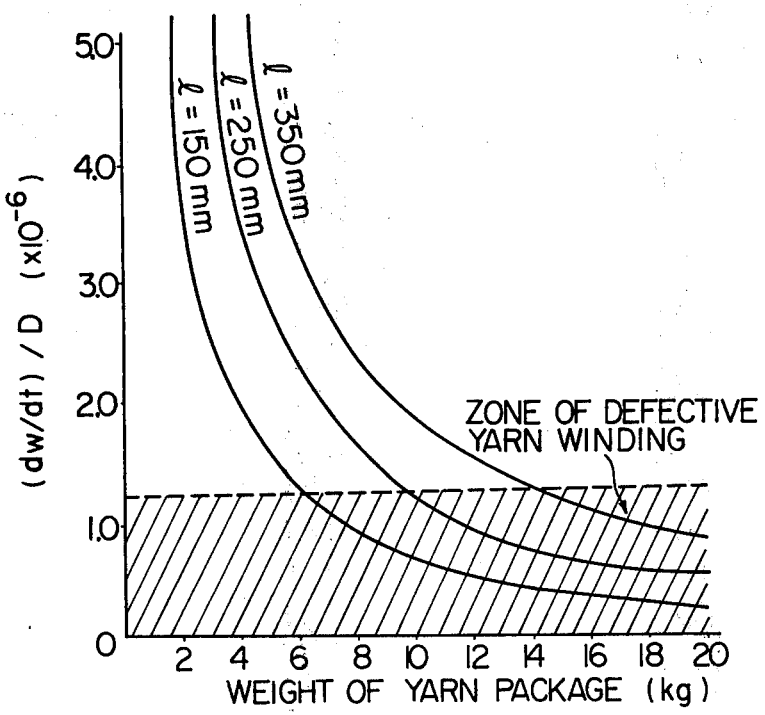
FIG. 2 is a graphical representation showing a relation between (dw/dt)/D and the weight of a yarn package during the winding operation.

Before explaining the improved method and apparatus for winding a thread on a bobbin at a high winding speed, according to the present invention, the fundamental research carried out to find the principle of the present invention will be explained. As already pointed out, when the revolutions per minute of the bobbin during the winding operation have some integral relationship to the traverse rate, so-called ribboning is created, and when such type of ribboning is created during the winding operation of synthetic threads of filaments on a bobbin, there is a strong possibility of creating defective yarn winding. Consequently, to find the time of creation of the defective yarn winding, the relation between the number of winds *w*, which is defined as the number of bobbin revolutions per one reciprocal traverse motion, and the size of the yarn package during the winding operation, is first investigated. The graphical representation shown in FIG. 1 is for three different conditions wherein the axial lengths of the yarn packages are 150 mm, 250 mm and 350 mm, respectively. The weight of the yarn package is used to identify the size thereof. As shown in FIG. 1, the relation between the number of threads w and the weight of the yarn package can be represented by an exponential curve for each of these three conditions. During the research it was confirmed that, in each condition, the defective yarn winding is created in a zone represented by hatching in FIG. 1. According to the representation shown in FIG. 1, it seems that there is a certain critical condition linking the number of winds w and the creation of the defective yarn winding. After careful study of the representation shown in FIG. 1, it was found that, if the above-mentioned exponential curves are redrawn as a relation between (dw/dt)/D and the weight of the yarn package during the winding operation, wherein D represents the thickness of the thread in denier and t represents seconds, the above-mentioned critical condition of each condition of the axial width of the yarn package is a substantially constant value of (dw/dt)/D, as shown in FIG. 2. That is, this critical condition is almost $(dw/dt)/D \approx 1.20\times10^{-6}$.

The above-mentioned fundamental research and analysis, reveals the principal idea of how to prevent the creation of the defective yarn winding. That is, if the yarn winding on the previously formed yarn layer on the bobbin is more tightly wound in comparison with the previous winding condition before (dw/dt)/D is reduced to the critical value $1.20\times10^{-6}$, any possibility of sliding the yarn layer formed on the axial end portions of the yarn package toward the axial center thereof can be prevented.

According to our experience, the above-mentioned ribboning and therefore, the defective yarn winding, may be created once or twice or more due to the winding condition and the type of thread being wound on a bobbin after the above-mentioned critical condition. Consequently, the above-mentioned control action must be applied just before each possible occurence of a defective yarn winding caused by ribboning.

Several tests were made to find an effective method to control the tightening of the winding yarn on the previously formed yarn layer of the yarn package, so as to prevent the creation of the defective yarn winding. It was found that by changing the winding yarn tension or the contact pressure between the yarn package and the friction driving roller, the above-mentioned tightening of the winding yarn can be controlled.

During our repeated mill tests, it was confirmed that, if the winding yarn tension is increased stepwise before the time derivative of the number of winds decreases to a value equalling $1.20\times10^{-6}$D, more particularly, at a time defined by $1.20\times10^{-6}D \leqq (dw/dt) \leqq 3.0\times10^{-6}D$, a defective yarn winding always can be prevented. However, if the winding yarn-tension is increased before dw/dt decreases to a value equalling $3.0\times10^{-6}$D, certain traverse miss of the thread at both ends of the yarn package frequently occurs, so that smooth unwinding of the thread from the yarn package in the subsequent process is impossible. On the other hand, it was also confirmed during out tests, that if the winding yarn-tension is increased after dw/dt falls below a value equal to $= 1.20\times10^{-6}$D, it is impossible to perfectly prevent the occurance of a defective yarn winding.

Since the winding yarn tension affects the quality of the thread of the yarn package, for example, the dyeability of the thread, it is important to find a suitable yarn tension for producing a good quality yarn package. That is, if the winding yarn-tension stepwise increase during the winding operation is excessively strong in comparison with the previous yarn tension, the dyeability of the thread portion after the increase of the winding yarn tension may be different from that of the thread portion before the increase of the winding yarn tension. On the other hand, if the winding yarn-tension stepwise increase is insufficiently strong, it is impossible to prevent the occurance of a defective yarn winding.

During our repeated tests, it was found that, in the case of taking-up a thread of 225 denier at a speed of 3500 m/min to form a yarn package, the change ratio of the winding yarn tension after the stepwise increase to the winding yarn tension before the stepwise increase can be perfectly fixed in a range between 20 and 100%, more particularly in a range between 40 and 60%. Therefore, the above-mentioned range of the change ratio is a solution to how to select the increased winding yarn-tension to prevent the occurrence of a defective yarn winding. In order to use the experimentally determined critical conditions for dw/dt for controlling the tension in a thread winding machine, it is necessary to develop an equation for *w* as a function of time *t*. The defining equation for the number of winds w during one complete traverse motion of the yarn guide may be expressed mathematically as, $$w = (R/Tr), \tag{1}$$

where $R$ = rotation speed of the yarn package in revolutions/min. and $Tr$ = traverse rate in traverses/min.

Conversion of the above equation to an expression of *w* in terms of time *t* is easily done by considering the simple geometric relations involved in the winding operation. First of all, the rotation speed R is related to the linear thread velocity Vs by the simple equation, $$R = \frac{Vs}{\pi d}, \tag{2}$$

where $d$ = the instantaneous diameter, in centimeters, of the thread package at a time *t* after commencement of winding.

At the same time *t*, the annular volume of thread wound on the package is clearly equal to, $$L\left(\frac{\pi d^2}{4} - \frac{\pi d_o^2}{4}\right), \tag{3}$$

where

L = traverse length in centimeters and $d_o$ = outer diameter of the bobbin in centimeters.

The volume of thread wound on the package after a time *t* can also be expressed in terms of delivery rate as, $$\frac{Q}{\rho} \cdot t, \tag{4}$$

where

Q = weight rate of thread delivery in g/min., $\sigma$ = thread density in g/cm$^3$, and $t$ = time in minutes.

Since expressions (3) and (4) are both equal to the volume of thread wound on the package after a time $t$, they are equal to each other, $$L\left(\frac{\pi d^2}{4} - \frac{\pi d_o}{4}\right) = \frac{Q}{\rho} \cdot t, \tag{5}$$

Solving equation (5) for d yields, $$d = \left[\frac{4}{\pi}\left(\frac{Q}{\rho L}\right) t + d_o^2\right]^{\frac{1}{2}}, \tag{6}$$

Substituting the expression for d in equation (6) into equation (2), and then substituting the resulting expression for R into equation (1) yields the following equation for number of winds w per traverse in terms of time t, $$w = \frac{Vs}{\pi Tr}\left[\frac{4}{\pi}\left(\frac{Q}{\rho L}\right) t + d_o^2\right]^{-\frac{1}{2}}, \tag{7}$$

Since all the other terms Vs, Tr, Q, $\sigma$, L, and $d_o$ are fixed for a given winding apparatus and bobbin size, equation (7) defines $w$ as a function of winding time $t$, only. It is thus a simple matter to take the time derivative of equation (7) and set the result equal to the experimentally determined high and low critical values of $3.0 \times 10^{-6}$D and $1.2 \times 10^{=6}$D, respectively. Substituting the known values for Vs, Tr, Q, $\sigma$, L, and $d_o$ then provides a solution for the beginning and ending times $t$ of the critical period during which the stepwise increment in winding tension must be made.

These calculated times $t$ either can be used directly, by setting a timer to actuate the thread stepwise tensioning means, or they can be substituted back into equation (6) to solve for the range of thread package diameters at which the tension incrementing means should be actuated. A preferable embodiment of the winding apparatus provided with a winding yarn tension control means according to the present invention is hereinafter explained in detail with reference to FIG. 3.

Figure 3:
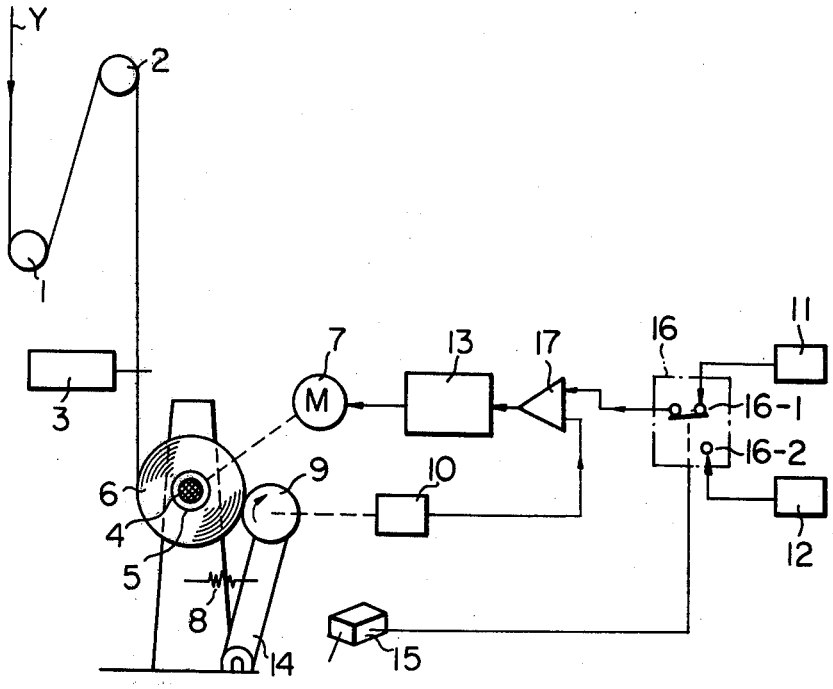
FIG. 3 is a schematic side view of a winding device provided with a device for automatically changing the tension of the winding yarn, according to the present invention.

The winding apparatus shown in FIG. 3 is a type in which the spindle, whereon a bobbin is mounted, is driven. The thread Y is supplied to the take-up device of the winder via a pair of godet rollers 1 and 2, at a constant speed. The thread Y is wound on a bobbin 5 supported by a bobbin holder 4 while traversing by means of a traverse mechanism 3 at a constant traversing speed, so that a yarn package 6 is formed on the bobbin 5. The bobbin holder 4 is driven by a driving motor 7. The rotational speed of the driving motor 7 is controlled by a controller 13 as explained hereinafter. That is, in this embodiment, a touch roller 9, rotatably supported by a supporting arm 14, is urged against the yarn package 6 by a tension spring 8 so that the touch roller 9 is rotated at a speed identical to the peripheral speed of the yarn package 6. Therefore, the peripheral speed of the yarn package 6 can be detected by means of a speed counter 10 which is connected to the touch roller 9. The supporting arm 14 is turnably mounted on a machine frame. A tachometer generator can be preferably used as the abovementioned speed counter 10. The output voltage from the speed counter 10 is applied to a first input of a voltage comparator 17, while a first or second constant voltage from a first setting means 11 or second setting means 12, is selectively applied to a second input of the voltage comparator 17 through a switching means 16, wherein the first and second setting means 11 and 12 are both realized by conventional potentiometers while the switching means 16 is realized by a conventional transfer type relay. A limit switch 15 is disposed at a position adjacent to the supporting arm 14 in such a condition that, in the initial situation of the takeup operation before increasing the winding yarn tension, the limit switch 15 is maintained free from the supporting arm 14, but when the time derivative of the number of winds $w$ in the relation to the thickness of thread O, that is (dw/dt)/D, reaches a predetermined value, the supporting arm 14 actuates the limit switch 15. Such critical condition of the predetermined value corresponds to a certain diameter of the yarn package 6 and, consequently, the above-mentioned critical condition can be detected by the urging of a feeler (not shown) of the limit switch 15 by the supporting arm 14, when the supporting arm 14 is turned to a position corresponding to the above-mentioned particular diameter of the yarn package 6. In the above-mentioned initial condition of the takeup operation, the contact of the switching means 16 is connected to a first terminal 16-1. Accordingly the first contact voltage from the first setting means 11 is applied to the second input of the voltage comparator 17. During a time when the $(dw/dt)$/D, is larger than a predetermined critical value, the supporting arm 14 does not actuate the limit switch 15. In such a condition, if the peripheral speed of the yarn package 6 is lower than a predetermined first peripheral speed which corresponds to a desired takeup speed before increasing the winding yarn tension, the output signal issued from the speed counter 10 is lower than a predetermined first output signal, and the voltage comparator 17 provides a positive voltage signal to the power supply controller 13. At a time when the peripheral speed of the yarn package 6 reaches the above-mentioned first peripheral speed, the output signal of the speed counter 10 reaches the above-mentioned first output signal, and the voltage comparator 17 provides no voltage signal to the power supply controller 13. As mentioned above, the driving motor 7 drives the bobbin 5 of the yarn package 6, that is, the yarn package 6, at the predetermined first peripheral rotation speed under the control action of the power supply controller 13. It must be noted that the above-mentioned first peripheral rotation speed corresponds to the first constant voltage provided from the first setting means 11. During the winding operation under the above-mentioned condition, the diameter of the yarn package 6 is gradually increased, and the supporting arm 14 is also gradually turned towards the limit switch 15, which is disposed at a particular position as mentioned above. When the supporting arm 14 contacts the feeler (not shown)of the limit switch 15, the output signal of the limit switch 15 actuates the switching means 16 so that the contact, which has connected the voltage comparator 17 to the first setting means 11, is changed to the alternate condition so as to connect the voltage comparator 17 to the second setting means 12, in such condition that the contact of the switching means 16 is connected to a second terminal 16-2. A power source which energizes the switching means 16 through the limit switch 15 is omitted in FIG. 3. Upon the above-mentioned actuation of the switching means 16, the driving motor 7 drives the yarn package 6 at a predetermined second peripheral rotation speed which is higher than the first peripheral rotation speed. Since the supply speed of the thread Y to the takeup device is maintained constant, the winding yarn-tension is increased by a ratio which corresponds to the ratio of increase of the peripheral speed of the yarn package 6. In the above-mentioned new condition, the second constant voltage from the second setting means 12 is applied to the second input of the voltage comparator 17, whereby the driving motor 7 drives the yarn package 6 at the predetermined second peripheral rotation speed, which corresponds to the second constant voltage provided from the second setting means 12. And if the level of the output voltage from the speed counter 10 is lower than the level of the second constant voltge, the voltage comparator 17 provides a positive voltage signal as described for the condition utilizing the first setting means 11. Consequently, the yarn package 6 can be driven at the second peripheral rotating speed. As mentioned above, the winding yarn is more tightly formed on the previously formed yarn layer of the yarn package after changing the peripheral rotation speed of the yarn package 6, so that any possible creation of a defective yarn winding can be perfectly prevented.

The following numerical example illustrates the application of the previously derived equation for w in terms of $t$ to the apparatus disclosed in FIG. 3.

EXAMPLE:

Assume that yarn of 225 denier and density of 0.97 g/cm$^3$ is being wound on a bobbin under the following conditions:

Vs = 3500 m/min.

$Q$ = (Vs)D/9000) = 87 g/min.

$Tr$ = 15 cm.

$d_o$ = 8.9 cm.

Substituting the above values into equation (7) above, taking the derivative of $w$ with respect to time, and setting $dw/dt$ equal to $3.0\times10^{-6}$D, yields a value for $t$ of 1320 seconds. Substituting this value of t into equation (6) above, provides a value for the diameter d of the yarn package equal to 15.7 cm. Limit switch 15 of FIG. 3 can then be set to be actuated when the yarn package reaches this value.

Figure 4:
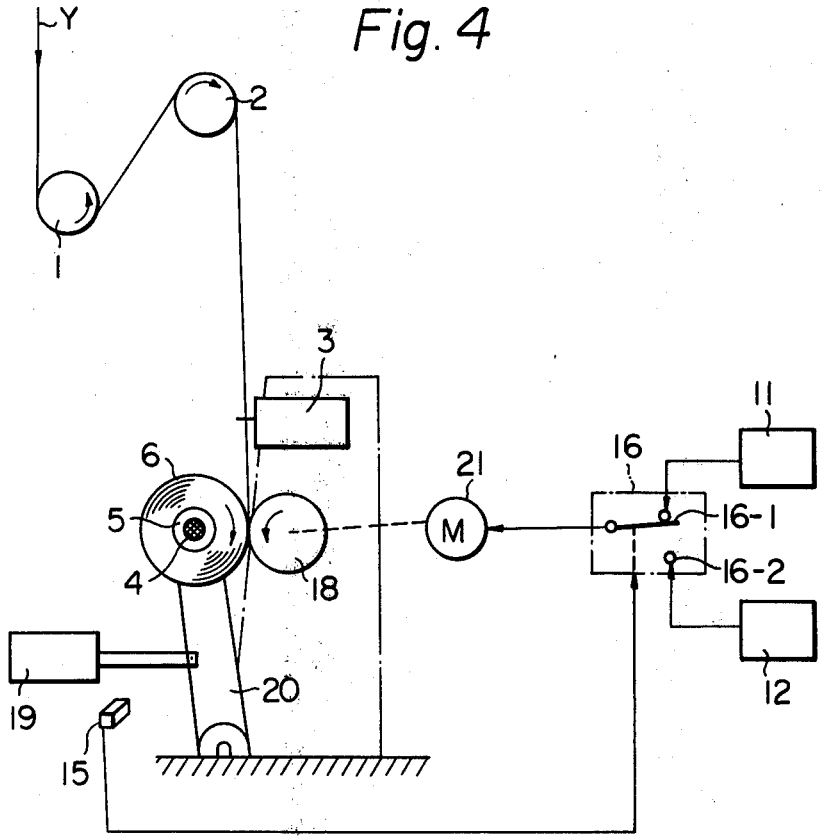
FIGS. 4, 5, 6, 7 and 8 are schematic side views of winding devices provided with modified automatic yarn-tension changing devices, respectively, according to the present invention.

Referring to FIG. 4 wherein the takeup apparatus provided with a modified embodiment of the winding yarn-tension control device according to the present invention is shown, the take-up apparatus is provided with a friction driving roller 18. In this take-up apparatus, the thread Y is supplied to the friction drive roller 18 at a constant speed by way of the godet roller 1 and 2 so that a yarn package 6 is formed on a bobbin 5. The bobbin 5 is rotatably supported by a bobbin holder 4 which is mounted on a supporting arm 20. The supporting arm 20 is turnably mounted on a machine frame 1 and an urging device 19 is connected to the supporting arm 20 in such a condition that the yarn package 6 is always urged against the friction driving roller 18 under a constant force during the winding operation.

When the diameter of the yarn package 6, is increased, the supporting arm 20 is gradually turned in a direction away from the friction driving roller 18. The thread Y is provided with a traverse motion by means of a traverse mechanism 3 positioned just upstream of the friction driving roller 18. A conventional pneumatic cylinder or compression spring means may be utilized as the urging device 19. The friction driving roller 18 is driven by a driving motor 21 which is alternatively connected to the first setting means 11 or the second setting means 12 by way of the switching means 16. These first and second setting means 11, 12 are conventional potentiometers while the switching means 16 is a conventional transfer type relay. Consequently the driving speed of the motor 21 can be changed by changing the connection of the motor 21 with the first setting means 11 or the second setting means 12, as in the first embodiment shown in FIG. 3. The limit switch 15 is disposed at a particular position as in the first embodiment. That is, in the initial situation of the take-up operation before increasing the winding yarn tension, the limit switch 15 is maintained free from the supporting arm 20, but when the ratio of the time rate of change in the number of winds w to the thickness D of thread Y, that is, $(dw/dt)/D$, reaches a predetermined value, the supporting arm 20 actuates the limit switch 15. The limit switch 15 is connected to the switching means 16 so as to actuate the switching means 16 when the supporting arm 20 actuates the limit switch 15.

The relation between the driving speeds of the motor 21 defined by the first and second setting means is quite similar to the first embodiment. Further the above-mentioned predetermined condition when the supporting arm 20 actuates the limit switch 15 is fixed in the same condition as in the first embodiment of the invention. Therefore, when $(dw/dt)/D$ reaches a predetermined condition, the supporting arm 20 actuates the limit switch 15 so that the switching means 16 is actuated to connect the motor 21 with the second setting means 12 and, thereby, the motor 21 is driven at a second driving speed. Therefore, the winding yarn tension is elevated in the predetermined condition so that any possibility of the creation of a defective yarn winding can be satisfactorily prevented. During our tests it was found that the desirable increase of the take-up speed, which corresponds to the driving speed of the motor 21, in comparision with the initial take-up speed is in a range between 0.1–1.0%, preferably in a range between 0.2 and 0.6%.

Figure 5:
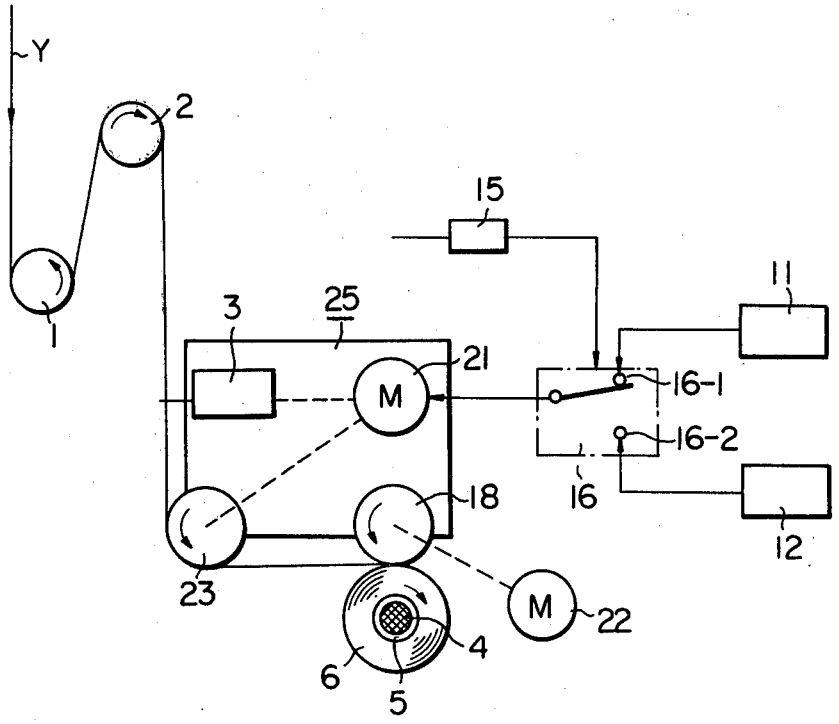

In the take-up apparatus shown in FIG. 5, a friction drive system, which is similar to the second embodiment shown in FIG. 4, is applied to form a yarn package 6 on a bobbin 5. The bobbin 5 is rotatably supported by a bobbin supporting member 4. The thread Y is supplied to the godet rollers 1 and 2 and then to the take-up device mounted on a sliding block 25 which is capable of displacing upward according to the increase in diameter of the yarn package 6. The mechanism of such sliding block 25 is well-known in the art and, therefore, the detailed explanation thereof is omitted. The traverse motion mechanism 3, the friction driving roller 18 and a split drum 23 are mounted on the sliding block 25, and the driving motor 21 for driving the split drum 23 and the traverse mechanism 3 is also mounted on the sliding block 25 as shown in FIG. 5. A driving motor 22 is also disposed on the sliding block 25 so as to drive the friction driving roller 18 at a constant driving speed.

The thread 2 is introduced to the friction roller 18 by way of the traverse motion mechanism 3 and the split drum 23. The friction driving roller 18 is always urged against the yarn package 6 under the dead weight of the assembly of the sliding block 25. Therefore the contact pressure of the driving roller 18 upon the yarn package 6 can be maintained constant during the winding operation.

The driving motor 21 is driven by connecting it with the first setting means 11 or the second setting means 12 by way of the switching means 16. The construction and functions of these electric elements are quite similar to those of the first and second embodiments. The limit switch 15 is disposed at a particular position where the feeler (not shown) of the limit switch 15 is actuated by the sliding block 25 when the diameter of the yarn package 6 becomes a predetermined size, which corresponds to the predetermined critical condition for increasing the winding yarn-tension to prevent the possible creation of a defective yarn-winding. That is, the sliding block 25 is gradually displaced upward according to the gradual increase in diameter of the yarn package 6, and when the diameter of the yarn package 6 becomes the above-mentioned predetermined size, the sliding block 25 actuates the feeler (not shown) of the limit switch 15. Therefore, the switching means 16 changes the connection between the motor 21 and the first setting means 11 to the connection between the motor 21 and the second setting means 12 by way of the switching means 16. Accordingly, the driving speed of the split drum 23 is stepwisely decreased so that the yarn tension between the split drum 23 and the yarn package 6 is stepwisely increased so as to prevent the possible creation of a defective yarn winding. If the frequency of the first setting means 11 is much larger than the frequency of the second setting means 12, there is some danger of the thread Y being wrapped about the split drum 23 or the godet rollers 1 or 2, or of breaking the thread Y. On the other hand, if the difference between the frequencies of the first and second setting means 11, 12 is too small, the above-mentioned prevention of the creation of a defective yarn winding can not be ensured.

Based on our tests, the condition for increasing the frequency of the input of the motor 21 from the initial condition, defined by the first setting means, is preferably set in a range between 1.0–8.0%, more particularly in a range between 2.5–5.0% under a yarn supplying speed of 3500 m/min.

Figure 6:
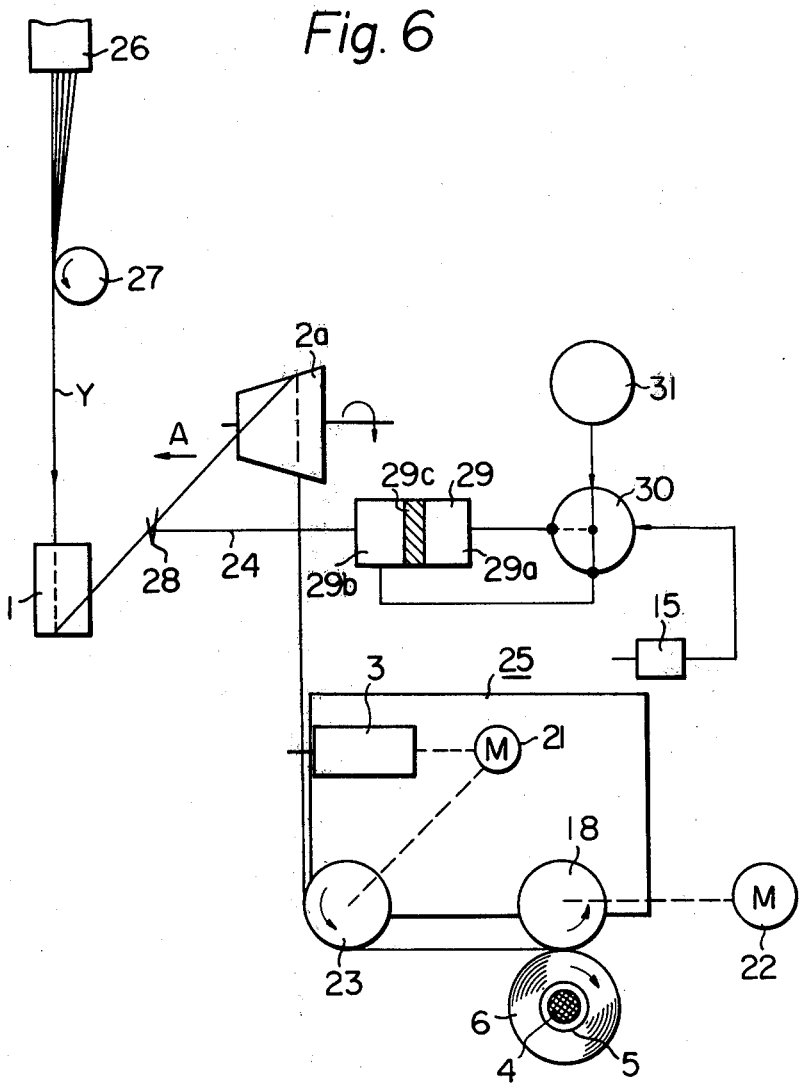

The take-up device shown in FIG. 6 is a modification of the embodiment shown in FIG. 5. Therefore, only the difference between these two embodiments is hereinafter explained. In the embodiment shown in FIG. 6, the synthetic multifilament thread Y is extruded from a spinning device 26 and fed to the take-up device mounted on the sliding block 25 by way of an oiling roller 27 and a pair of godet rollers 1 and 2*a*. The godet roller 2*a* is a conical roller as shown in FIG. 6. A thread quide 28 is disposed at a position between these godet rollers 1 and 2*a* so as to define the feeding-in point of the thread Y to the godet roller 2*a*. The thread guide 28 is mounted on a free end of a piston rod 24 of an air-cylinder 29 which is connected to a compressed air supply source 31 through a magnet valve 30. The magnet valve 30 is a so-called three way valve which is capable of alternatively connecting the compressed air supply source 31 to a chamber 29*a* or a chamber 29*b* formed at the two sides of a piston 29*c* of the air cylinder 29, respectively. Therefore, when the diameter of the yarn package 6 becomes a predetermined condition, corresponding to the critical time for increasing the winding yarn tension, the sliding block 25 contacts a feeler (not shown) of the limit switch 15. When the sliding block 25 contacts the limit switch 15, the limit switch 15 actuates the magnet valve 30 so as to disconnect the chamber 29*b* from the compressed air supply source 31 and connect the chamber 29*a* with the compressed air supply source 31. Consequently, the piston 29*c* is displaced in a direction A, shown in FIG. 6, so that the thread quide 28 is also displaced toward the direction A. The above-mentioned displacement of the thread guide 28 is restricted by a stop (not shown). When the magnet valve 30 connects the chamber 29*b* to the compressed air supply source 31, the piston 29*c* of the air cylinder 29 is displaced to its standby position shown in FIG. 6.

In this embodiment, the traverse motion mechanism 3 and the split drum 23 are driven by the driving motor 21 at a constant speed. If the thread guide 28 is positioned at a first position, which corresponds to the standby position of the piston 29*c*, so as to guide the thread Y to a position of a large diameter of the godet roller 2*a*, the yarn package 6 is formed in an initial condition of the winding yarn tension. When the thread guide 28 is displaced to a second position, which corresponds to the position where the piston 29*c* is displaced to the left side (in FIG. 6) of the chamber 29*b*, the thread guide 28 changes the feeding-in point of the thread Y to a position on the godet roller 2*a* where the diameter is smaller than the initial feeding-in position to the godet roller 2*a* and, as a result, the carrying speed of the thread Y by the godet roller 2*a* is lowered. Since the split drum 23 is always driven at a constant driving speed, when the carrying speed of the thread Y is lowered as mentioned above, the winding yarn tension is increased due to the above-mentioned change of the carrying speed of the thread Y by the godet roller 2*a*. The possible creation of a defective yarn winding can be effectively prevented by the above-mentioned change of the winding yarn tension.

Figure 7:
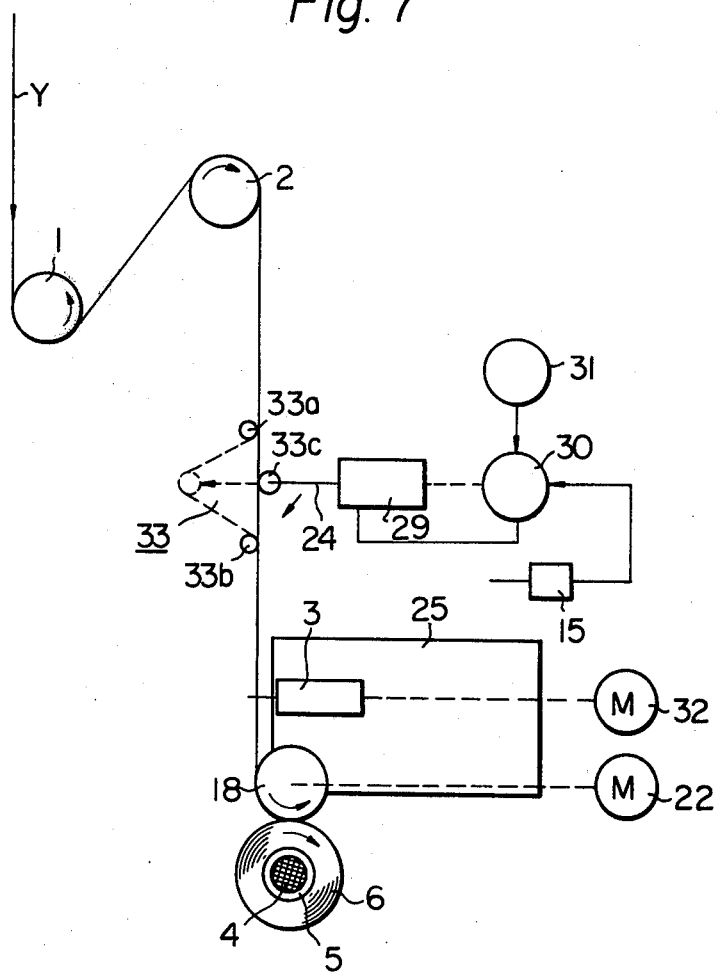

The take-up device shown in FIG. 7 is another modification of the embodiment shown in FIG. 5. Therefore, only the difference between these two embodiments is hereinafter explained in detail. In the embodiment shown in FIG. 7, the traverse motion mechanism 3, the friction driving roller 18, the motor 22 for driving the friction driving roller 18 at a constant speed and a motor 32 for driving the traverse motion mechanism 3 at a substantially constant speed are mounted on the sliding block 25. When the diameter of the yarn package 6 is gradually increased, the sliding block 25 is also gradually displaced upward, as in the above-mentioned two embodiments shown in FIGS. 5 and 6, and the yarn package 6 is always urged downward by the weight of the assembly of the sliding block 25. The limit switch 15, the magnet valve 30, the air cylinder 29 and the compressed air source 31 are arranged in the same condition as in the embodiment shown in FIG. 6. A yarn tension control device 33 is disposed at a position along the yarn passage between the godet roller 2 and the friction driving roller 18. The yarn tension control device 33 comprises a pair of guide rollers 33*a*, 33*b* rotatably disposed at respective stationary positions and a guide roller 33*c* displaceably disposed at a position between the rollers 33*a* and 33*b*. The guide roller 33*c* is rotatably mounted on a free end of the piston rod 24 of the air-cylinder 29. In the initial winding condition, the thread Y passes through the yarn tension control device 33 in such a way that the thread Y passes over these guide rollers 33*a*, 33*c* and 33*b* in straight condition as shown by a solid line in FIG. 7. However, when the limit switch 15 is actuated by the sliding block 25 so as to increase the winding yarn tension, the piston rod 24 is pushed out from the air cylinder 29, in a similar manner to the embodiment shown in FIG. 6, so that the guide roller 33*c* is displaced to a projected position as shown by a broken line in FIG. 7. Accordingly, the thread Y is forced to pass through the yarn tension control device along a triangle passage over the guide rollers 33*a*, 33*c* and 33*b*.

When the yarn passage is changed in the tension control device 33 as mentioned above, the tension of the thread Y is increased so that the possible creation of a defective yarn winding can be effectively prevented. In the above-mentioned embodiment, proper selection of the surface condition of the guide rollers 33*a*, 33*b* and 33*c* is important. During our experimental tests, it was found that a ceramic aluminum material having a roughened surface of 0.2–5S roughness can be preferably utilized to make the guide rollers 33*a*, 33*b* and 33*c*.

Figure 8:
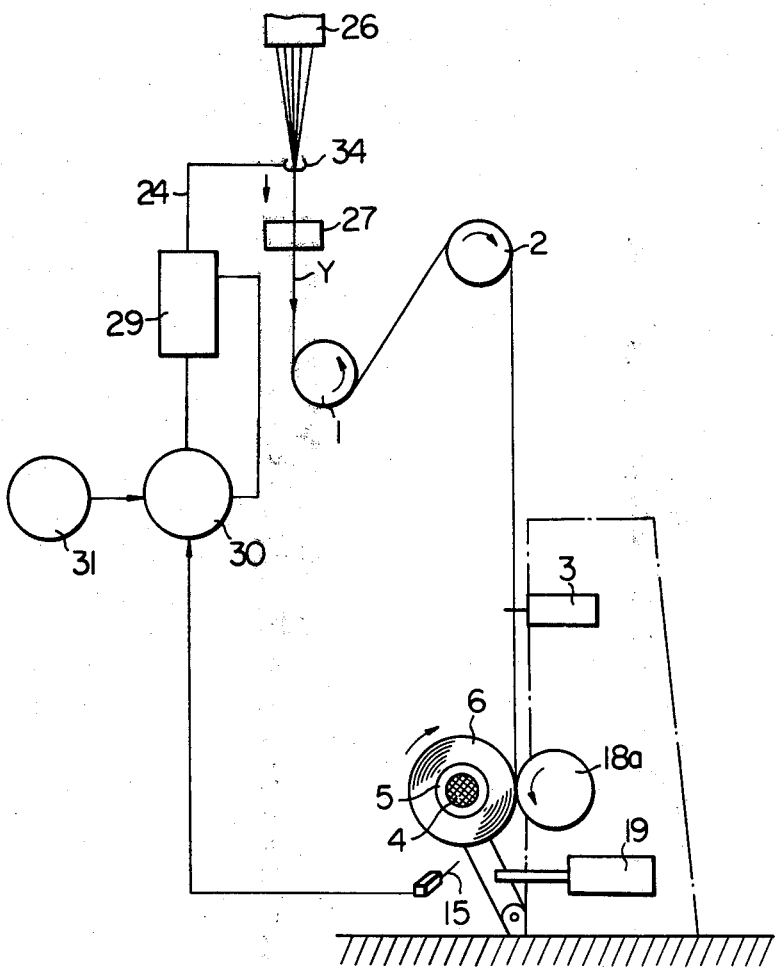

The take-up apparatus shown in FIG. 8 is a modification of the embodiment shown in FIGS. 4 and 6. In the embodiment shown in FIG. 8, a friction driving roller 18*a* is driven at a constant speed by a driving motor (not shown). The synthetic multifilaments extruded from the spinning device 26 are collected as a thread Y by means of passing a collector 34 which is displaceably disposed at a position upstream of the oiling roller 27. This collector 34 is supported by the piston rod 24 of the air cylinder 29 which is actuated by the magnet change valve 30. The magnet change valve 30 is connected to the compressed air source 31 so as to supply compressed air into the chambers (not shown) of the air cylinder 29.

The elements of this embodiment having the same function as the embodiments shown in FIGS. 4 and 6 are designated by identical reference numerals, and the explanation thereof is omitted. When the collector 34 is displaced downward toward the oiling roller 27, the tension of the thread Y is increased because a gas current is created at a position adjacently downstream of the spinning device 26. Such creation of gas current is due to the solidification of the extruded filaments by cooling. In such condition of the gas current, when the collector 34 has changed its position, the condition of separation of the extruded filaments is changed. For example, if the collector 34 is displaced downward, the extruded filaments are separated in a more laterally expanded space in comparison with the condition when the collector 34 is positioned at an upper position. In the laterally expanded separation condition of the filaments, the effect of the gas current on the filaments is increased so that the tension of the thread Y is increased. According to our experimental tests, in the case of spinning a synthetic multifilament having a total thickness 225 denier, at a spinning speed of 3500 m/min and at a blowing speed of the cooling gas of 0.42 m/sec., the distance between the spinning device 26 and the collector 34 can be preferably increased in a range between 10 and 25%, in comparison with the initial condition, before the critical time for increasing the winding yarn tension so as to prevent the possible creation of a defective yarn winding.

In the above-mentioned embodiment, so-called programmed control of the winding yarn-tension control can be effectively applied, instead of utilizing the limit switch 15. That is, a timing relay assembly, which actuates the tension control device after carrying out the winding operation for a predetermined time, which corresponds to $(dw/dt)/D \geqq 1.20 \times 10^{-6}$, can be satisfactorily utilized to attain the purpose of the present invention.

Figure 9:
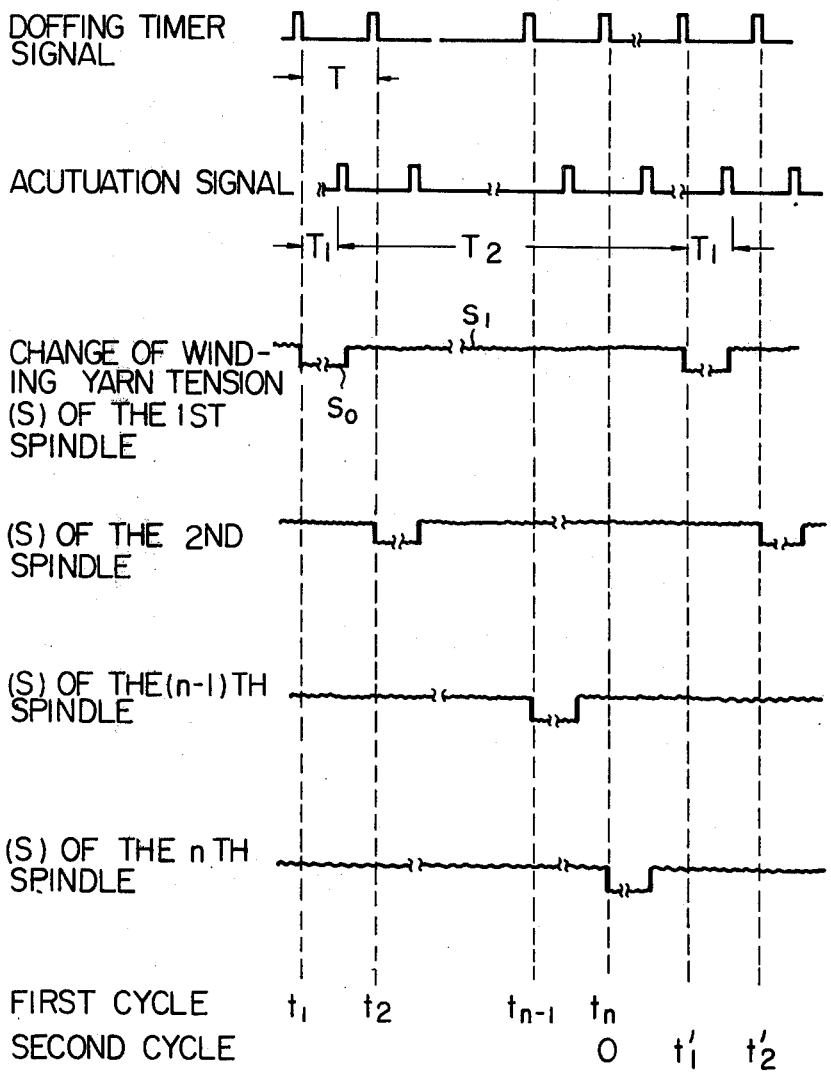
FIG. 9 is an explanatory diagram indicating the relation between time-sequence of the yarn tension control operation applied to a plurality of winding units in relation to the time sequence of the doffing operation.

The diagram shown in FIG. 9 represents the time sequence of the above-mentioned programmed control of the winding yarn-tension applied to a group of takeup devices. That is, in the case of application of the programmed control of the winding yarn tension upon a group of takeup devices having *n* takeup devices, doffing time signals are sequentially issued with a predetermined time interval T, after the first takeup device, which first commences the winding operation, comes to a time for carrying out the doffing operation. An actuation timer is utilized to actuate the winding yarn-tension control means of each takeup device. This actuation-timer is reset by a signal issued from a doffing-timer which is utilized for carrying out the doffing operation of the corresponding takeup device, and issues an actuation signal at a predetermined time $T_1$ after the doffing-timer issues the doffing signal. This predetermined time $T_1$ corresponds to the above-mentioned critical time. If an automatic winding tension control means 33 shown in FIG. 7 is utilized, the magnet valve 30 is actuated by the signal issued from the actuation-timer (not shown), so that the yarn passage in the tension control means 33 is changed as indicated by a curved broken line and, accordingly, the winding yarn tension is stepwisely increase so as to prevent the possible creation of a defective yarn winding. The winding operation under this condition is carried out until the doffing-timer issues the doffing signal for a time represented by $T_2$ in FIG. 9. Therefore, $(T_1+T_2)$ is a time for carrying out the complete winding operation to form a full yarn package on a bobbin. When the doffing-timer issues the doffing signal, the actuation timer is reset so that the magnet valve 30 is reset so as to return the winding tension control means 33 to its initial condition.

The above-mentioned programmed control of the winding yarn tension is carried out sequentially to the group of takeup devices as shown in FIG. 9. For easier understanding of the above-mentioned sequential programmed control of the winding yarn tension, the sequential times of the first cycle of the doffing operation of the group of takeup devices are represented by $t_1$, $t_2$, . . . $t_{n-1}$, $t_n$, and those of the second cycle are represented by $t_1'$, $t_2'$ . . . , in FIG. 9. In the diagram showing the change of winding yarn tension (S), $S_0$ indicates an initial condition of the winding yarn tension, while $S_1$ indicates the increased condition thereof.

As mentioned above, in the group of takeup devices, the possible creation of a defective yarn winding during the winding operation can be effectively prevented by the programmed control of the winding yarn tension.

In the above-mentioned embodiments shown in FIGS. 3, 4, 5, 6, 7 and 8, the winding yarn tension is stepwisely increased at the predetermined time before the critical time so as to prevent the possible creation of a defective yarn winding. However, in the alternative embodiments shown in FIGS. 10, 11 and 12, the contact pressure between the friction roller 18 and the yarn package 6 is stepwisely increased at the predetermined time before the critical time instead of increasing the winding yarn tension.

Figure 10:
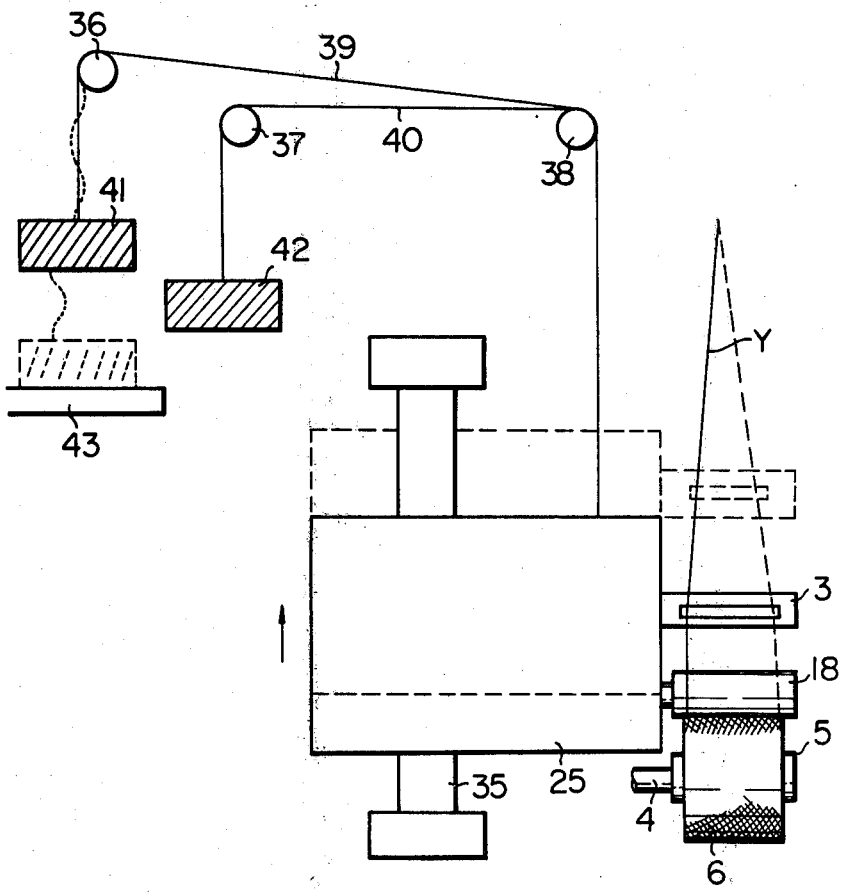
FIG. 10 is a schematic side view of a winding device provided with a device for automatically changing the contact pressure of a yarn package against a friction roller, according to the present invention.

FIG. 10 shows a take-up device of the friction driving roller type. In the embodiment shown in FIG. 10, the thread Y is introduced to the friction roller 18 by way of the traverse motion mechanism 3. The traverse motion mechanism 3 and the friction driving roller 18 are mounted on the sliding block 25 and driven by a driving means mounted on the sliding block 25. The sliding block 25 is slidably mounted on a sliding guide 25 mounted on a machine frame (not shown) in the upright condition as shown in FIG. 10. Consequently, the yarn package 6 is always urged by the friction driving roller 18 due to the weight of the assembly of the sliding block 25, and the sliding block 25 is gradually displaced upward according to the increase in the diameter of the yarn package 6 during the winding operation. To adjust the above-mentioned contact pressure between the friction driving roller 18 and the yarn package 6, a pair of dead weights 41 and 42 are connected to the sliding block 25 by corresponding threads 39 and 40, respectively. The dead weight 41 is hung from a guide rod 36 by the thread 39 which also passes over a guide rod 38 disposed above the sliding block 25. Another guide rod 37 is also disposed above the sliding block 25 and the dead weight 42 is hung from the guide rod 37 by the thread 40 which also passes over the common guide rod 38. A supporting plate 43 is disposed at a position directly below the dead weight 41. Consequently, the actual contacting pressure of the friction driving roller 18 against the yarn package 6 is [(the weight of the assembly of the sliding block 25) - (the weight of the dead weights 41 and 42)] at the initial condition of the winding operation.

Since the sliding block 25 is displaced upward according to the increase in the diameter of the yarn package 6, the dead weights 41 and 42 are gradually displaced downward. Therefore, when the dead weight 41 contacts the supporting plate 43, the above-mentioned actual contact pressure is increased by the weight of the dead weight 41. Therefore, if the disposition of the supporting plate 43 is chosen in such a condition that the above-mentioned time of contacting the dead weight 41 with the supporting plate 43 corresponds to the predetermined time before the critical time, and the weight of the dead weight 41 is pertinently chosen, the possible creation of a defective yarn winding can be effectively prevented.

During our experimental tests, it was confirmed that the increased ratio of the above-mentioned contacting pressure to the initial condition must be chosen in a range between 10 and 60%, preferably between 20 and 40%, under the spinning speed of 3500 m/min. It was found that the time when the dead weight 41 comes into contact with the supporting plate 43 corresponds to a time when the diameter of the yarn package 6 is increased to such a condition that this diameter is more than 101%, preferably more than 105%, of the bobbin diameter.

Figure 11:
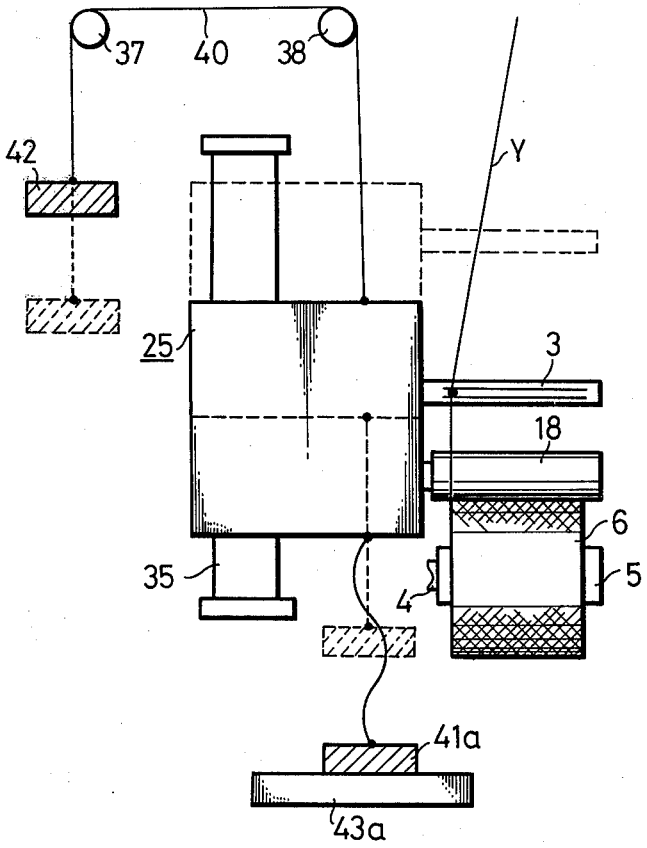
FIG. 11 is a schematic side view of a winding device which is a modification of the embodiment shown in FIG. 10.

A modification of the embodiment of FIG. 10 is shown in FIG. 11. In the following explanation of this embodiment, only the mechanism and function of the elements different from the embodiment shown in FIG. 10 are described, and the elements having the same function are identified by the same reference numerals used in FIG. 10.

In FIG. 11, a dead weight 41*a* is hung from the sliding block 25 so as to add to the contacting pressure between the contacting driving roller 18 and the yarn package 6. A plate 43*a* supports dead weight 41*a* until sliding block 25 is displaced upward to a predetermined position. With this modification, the same control result can be obtained as with the embodiment shown in FIG. 10.

Figure 12:
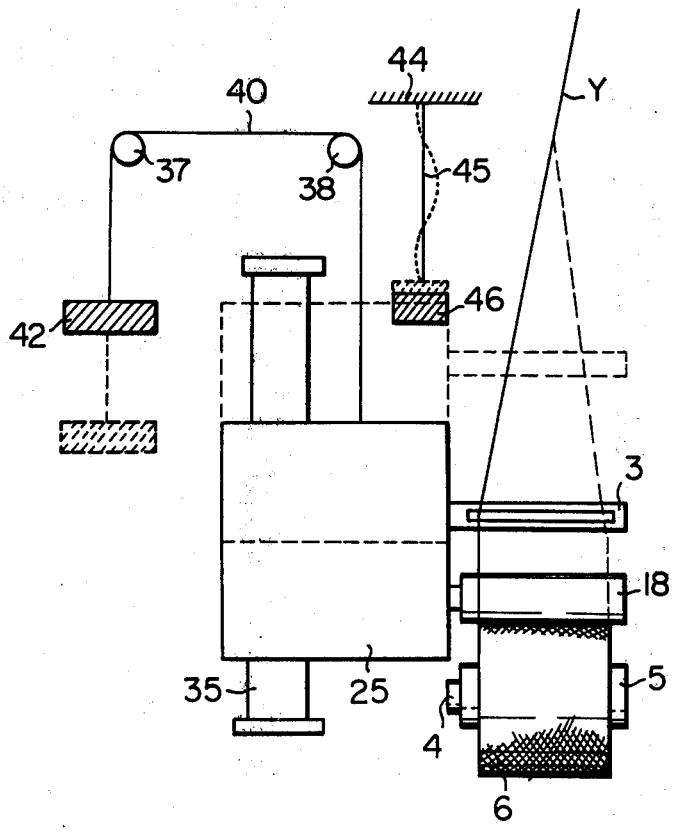
FIGS. 12 and 13 are schematic front views of a winding device provided with respective modified devices for automatically changing the contact pressure of a yarn package against a friction roller, according to the present invention.

The embodiment shown in FIG. 12 is a modification of the take-up device shown in FIG. 10. Therefore, only the differences between these two embodiments are hereinafter explained. In the embodiment shown in FIG. 12, a dead weight 46, hung from a supporting bracket 44 by way of a thread 45, is utilized instead of the dead weight 41 of the embodiment shown in FIG. 10. The supporting bracket 44 is disposed above the sliding passage of the sliding block 25 in such a condition that, when the sliding block 25 is displaced upward according to the increase in the diameter of the yarn package 6, and the diameter of the yarn package 6 is increased to a predetermined condition which corresponds to a predetermined time before the critical time, the dead weight 46 is laid on the sliding block 25 so that the actual contacting pressure of the friction driving roller 18 is increased from the weight of the assembly of the sliding block 25 to the weight of the assembly of the sliding block 25 plus the weight of the dead weight 46. Consequently, a result which is quite similar to the above-mentioned embodiment shown in FIG. 10 can be attained.

Figure 13:
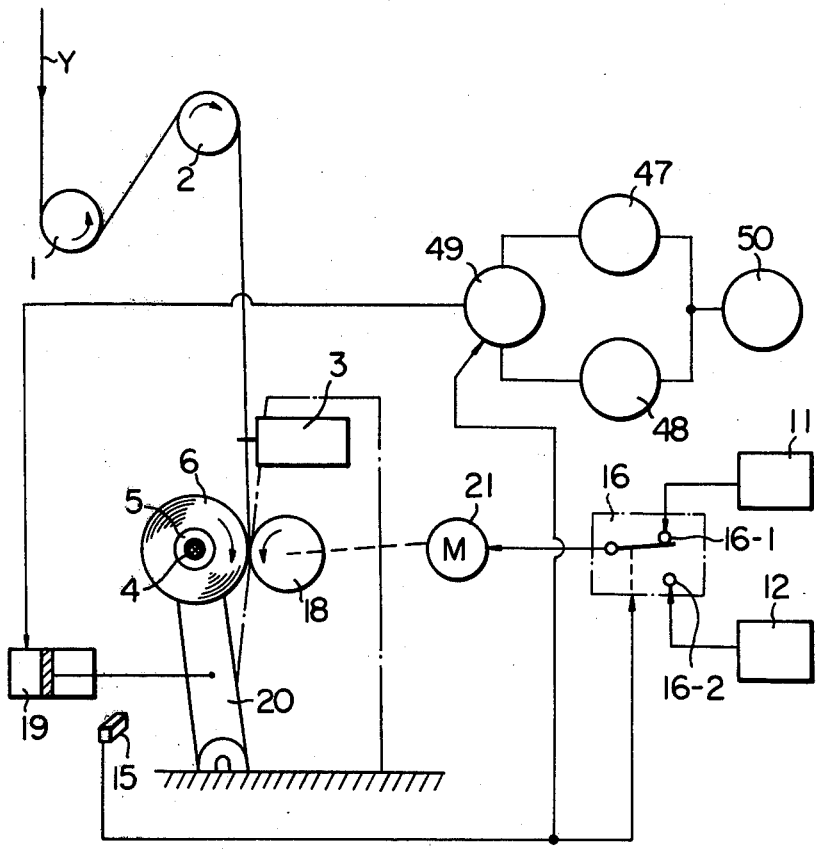

The embodiment of the take-up device shown in FIG. 13 is a modification of the embodiment shown in FIG. 4. Therefore, only the differences from the embodiment shown in FIG. 4 is hereinafter explained. In this embodiment, when the limit switch 15 is actuated to increase the winding yarn tension so as to prevent the possible creation of a defective yarn winding, the contacting pressure between the friction roller 18 and the yarn package 6 is also increased as hereinafter explained. A pair of automatic pressure control valves 47 and 48 are connected to a compressed air supply source 50. The air cylinder 19 is alternatively connected to the automatic pressure control valve 47 or the control valve 48 by way of the magnetic change valve 49. This magnetic valve 49 is actuated by a signal issued from the limit switch 15 in such a way that when the limit switch 15 issues a signal to increase the winding yarn tension of the thread Y, this signal is also applied to the magnetic change valve 49 so that the connection between the air cylinder 19 and the automatic pressure control valve 47 is changed to the connection between the air cylinder 19 and the automatic pressure control valve 48, which is fixed at a predetermined high pressure level in comparison with the control valve 47. Consequently, the contacting pressure between the friction driving roller 18 and the yarn packaged 6 is positively increased simultaneously at the time of increasing the winding yarn tension. By suitably setting the difference in the pressure levels between these two pressure control valves 47 and 48, and also fixing the frequency difference between the first and second setting means 11 and 12, a very effective control action for preventing the possible creation of a defective yarn winding can be provided.

In the above-mentioned embodiment shown in FIG. 13, the following modification is also useful to attain the purpose of the present invention. That is, in this modification the driving motor 21 is always driven at a constant speed during the winding operation, and the limit switch 15 is only connected to the magnet change valve 49.

What is claimed is:

1. In an operation for winding a synthetic thread on a cylindrical bobbin for producing a full size yarn package at a winding speed of more than 2500 m/min. an improvement comprising increasing the tightness of winding said thread on previously formed thread layers of said yarn package in at least one stepwise increment during a period of said winding operation when $1.20\times10^{-6}\leqq(dw/dt)/D\leqq3.0\times10^{-6}$, wherein $w$ represents number of bobbin rotations per one reciprocal traverse motion, $t$ represents time in minutes, and D represents the thickness of said thread in denier.

2. An improved winding method according to claim 1, wherein said stepwise increase in the tightness of winding said thread is attained by increasing the winding yarn tension.

3. An improved winding method according to claim 1, wherein said stepwise increase in the tightness of winding said thread is attained by increasing the contacting pressure between said yarn package and a friction driving roller during said winding operation.

4. An improved winding method according to claim 2, wherein said stepwise increase in winding yarn tension is in the range between 20% and 100% of the initial yarn tension.

5. An improved winding method according to claim 3, wherein said stepwise increase in contacting pressure is in the range between 10% and 60% of the initial contacting pressure.

6. In a winding apparatus for winding a synthetic thread on a cylindrical bobbin for producing a full size yarn package, the apparatus including a traverse motion mechanism and a take-up device, an improvement comprising, means for producing a stepwise increase in the winding tightness of said thread on a previously formed thread layer of said yarn package and means for actuating said means for producing a stepwise increase in the winding tightness at least once during a period of said winding operation when $1.20\times10^{-6}\leqq (dw/dt)/D\leqq 3.0\times10^{-6}$, wherein $w$ represents number of bobbin rotations per one reciprocal traverse motion, $t$ represents time in minutes, and D represents the thickness of said thread in denier.

7. An improved winding apparatus according to claim 6, further comprising a programmed control means for controlling the operation of said actuation means.

8. An improved winding apparatus according to claim 6, wherein said actuating means comprises a detecting means for detecting a predetermined winding condition before $dw/dt$ is reduced to a value of $1.20\times10^{-6}D$.

9. An improved winding apparatus according to claim 8, wherein said means for producing a stepwise increase in the winding tightness comprises a device for feeding said thread to said traverse motion mechanism at a constant speed and a driving mechanism for rotating said yarn package during said winding operation at driving speeds that are variable in stepwise increments, said driving mechanism being actuated by said actuating means to change the running speed thereof by a signal issued from said detecting means.

10. An improved winding apparatus according to claim 8, wherein said means for producing a stepwise increase in the winding tightness comprises a device for feeding said thread to said traverse motion mechanism at a constant speed, a split drum disposed between said traverse motion mechanism and said take-up device, means for driving said split drum in synchronism with said traverse motion mechanism, and a driving mechanism for driving said takeup device at a constant take-up speed, the running speed of said split drum and said traverse motion mechanism being reduced in a stepwise decrement by said actuating means in response to a signal issued from said detecting means when said detecting means detects said predetermined winding condition.

11. An improved winding apparatus according to claim 8, wherein said means for producing a stepwise increase in the winding tightness comprises a conical shaped godet roller disposed at a position upstream of said traverse motion mechanism, a thread guide disposed adjacent to said conical shaped godet roller at a position upstream of said godet roller, a mechanism for displacing said thread guide in stepwise increments to change the feeding-in point of said godet roller along an axial direction of said godet roller, said displacing mechanism being actuated by said actuating means in response to a signal issued from said detecting device upon occurrence of said predetermined winding condition.

12. An improved winding apparatus according to claim 8, wherein said winding apparatus is fed with thread from spinning equipment having at least one spinning device from which a bundle of multiple synthetic filaments is extruded, a cooling device creating a gas flow for solidifying said extruded synthetic filaments, and a collector disposed at a yarn passage below said spinning device where said gas flow is applied, wherein said means for producing a stepwise increase in the winding tightness comprises a mechanism for displacing said collector stepwise along the passage of said thread, said displacing mechanism being actuated by said actuating means in response to a signal issued from said detecting device upon occurrence of said predetermined winding condition.

13. An improved winding apparatus according to claim 8, wherein said means for providing a stepwise increase in the winding tightness comprises a plurality of stationary thread guides disposed at a position upstream of said traverse motion mechanism and at least one displaceable thread guide positioned between said stationary thread guides such that a thread passage is formed by the stationary and displaceable thread guides, and a mechanism for displacing said displaceable thread guide stepwise transversely to said thread passage to increase the length of said thread passage, said displacing mechanism being actuated by said actuating means in response to a signal issued from said detecting device upon occurrence of said predetermined winding condition.

14. An improved winding apparatus according to claim 6, wherein said winding apparatus is provided with a friction driving roller for rotating said yarn package and a vertically sliding block for mounting said traverse motion mechanism and said friction driving roller, and wherein said means for providing a stepwise increase in the winding tightness comprises at least one counterweight connected to said sliding block by means of a flexible thread, guide means for defining the passage of said flexible thread above said sliding block, a supporting plate disposed at a position for supporting said counterweight when said sliding block is displaced upward to a predetermined position, said actuating means being said sliding block which is capable of displacing upwardly according to the gradual increase in the diameter of said yarn package during the winding operation.

15. An improved winding apparatus according to claim 6, wherein said winding apparatus is provided with a friction driving roller for rotating said yarn package and a vertically sliding block for mounting said traverse motion mechanism and said friction driving roller, and wherein said means for producing a stepwise increase in the winding tightness comprises at least one dead weight hung from said sliding block by means of a flexible thread, and a supporting plate disposed below said sliding block at a position for supporting said dead weight until said sliding block is displaced upward to a predetermined position, said actuating means being said sliding block which is capable of displacing upwardly according to the gradual increase in the diameter of said yarn package during the winding operation.

16. An improved winding apparatus according to claim 6, wherein said winding apparatus is provided with a friction driving roller for rotating said yarn package and a vertically sliding block for mounting said traverse motion mechanism and said friction driving roller, and wherein said means for producing a stepwise increase in the winding tightness comprises at least one dead weight hunging from a frame body of said winding apparatus above said sliding block at a predetermined position such that when the top of said sliding block is displaced upward to said predetermined position according to the gradual increase in the diameter of said yarn package, said dead weight rests on said sliding block, said actuating means being said sliding block which is capable of displacing upwardly according to the gradual increase in the diameter of said yarn package during the winding operation.

17. An improved winding apparatus according to claim 6, wherein said winding apparatus is provided with a friction driving roller for rotating said yarn package and a driving mechanism for driving said friction roller at a constant driving speed, said actuating means comprises a detecting means for detecting a predetermined winding condition before *dw/dt* is reduced to a value of $1.20\times10^{-6}$D, and said means for producing a stepwise increase in the winding tightness comprises an urging means for urging said yarn package against said friction driving roller, said urging means being actuated by a signal issued from said detecting means in response to detection of said predetermined winding condition so as to increase the force urging said yarn package against said friction roller.

18. An improved winding apparatus according to claim 6, wherein said winding apparatus is provided with a friction driving roller for rotating said yarn package and a driving mechanism for driving said friction roller at speeds variable in stepwise increments; said means for producing a stepwise increase in winding tightness comprises a combination of first and second means, said first means being an urging means for urging said yarn package against said friction driving roller, said second means being said driving mechanism for running said friction driving roller at stepwise variable speed; and said actuating means comprises a detecting means for detecting a predetermined winding condition before *dw/dt* is reduced to a value of $1.20\times10^{-6}$D, said urging means being capable of increasing the urging force, and said driving mechanism being capable of increasing the running speed simultaneously with actuation of said urging means when said detecting means detects said predetermined winding condition and issues a signal to actuate said urging means and said driving mechanism.

* * * * *

UNITED STATES PATENT AND TRADEMARK OFFICE

CERTIFICATE OF CORRECTION

PATENT NO. : 4,059,239

DATED : November 22, 1977

INVENTOR(S) : Kikuo Hori et al

It is certified that error appears in the above-identified patent and that said Letters Patent are hereby corrected as shown below:

In the Abstract:

Equation should be:

$$1.20\text{x}10^{-6} \leqq (dw/dt)/D \leqq 3.0.10^{-6}$$

Col. 1, line 22, change "or" to --of--.

Col. 1, line 23, change "or" to --of--.

Col. 1, line 63, change "transverse" to --traverse--.

Col. 4, line 4, change "out" to --our--.

Col. 4, line 7, change "occurrance" to --occurrence--.

Col. 4, line 26, change "perfectly" to --preferably--.

Col. 5, line 36, change "$\sigma$" to --$\rho$--.

Col. 5, Equation #4, line 7, change "$\sigma$ " to --$\rho$ --.

Col. 6, line 17, change "O" to --D--.

Col. 6, line 39, change "a" to --the--.

Col. 7, line 19, correct spelling of "voltage".

Col. 7, line 49, change "the" to --a--.

Col. 7, line 59, after "frame" delete "l" and insert a --,--.

UNITED STATES PATENT AND TRADEMARK OFFICE

CERTIFICATE OF CORRECTION

PATENT NO. : 4,059,239

DATED : November 22, 1977

INVENTOR(S) : Kikuo Hori et al

It is certified that error appears in the above-identified patent and that said Letters Patent are hereby corrected as shown below:

Col. 13, line 2, change "25" second occurrence to --35--.

Col. 2, line 13, change formula to read as follows:

$$--dw/dt \approx 1.20 \times 10^{-6} D.--$$

Col. 3, line 33, change formula to read as follows:

$$--(dw/dt)/D \approx 1.20 \times 10^{-6}.--$$

Signed and Sealed this

Ninth Day of May 1978

[SEAL]

Attest:

RUTH C. MASON
Attesting Officer

LUTRELLE F. PARKER
Acting Commissioner of Patents and Trademarks